US009079301B2

(12) United States Patent
Doty

(10) Patent No.: US 9,079,301 B2
(45) **Date of Patent: *Jul. 14, 2015**

(54) PIPE FLANGE SPREADING TOOL

(75) Inventor: Arthur Doty, Round Rock, TX (US)

(73) Assignee: Arthur W. Doty, Round Rock, TX (US)

( * ) Notice: Subject to any disclaimer, the term of this patent is extended or adjusted under 35 U.S.C. 154(b) by 654 days.

This patent is subject to a terminal disclaimer.

(21) Appl. No.: 13/229,851

(22) Filed: Sep. 12, 2011

(65) Prior Publication Data

US 2013/0062583 A1 Mar. 14, 2013

(51) Int. Cl.

| | |
|---|---|
| ***B25B 11/00*** | (2006.01) |
| ***B25B 25/00*** | (2006.01) |
| ***E04G 17/06*** | (2006.01) |
| ***B25B 27/16*** | (2006.01) |
| ***B25B 27/14*** | (2006.01) |
| *B25B 27/00* | (2006.01) |

(52) U.S. Cl.

CPC ..... *B25B 27/16* (2013.01); *B25B 27/14* (2013.01); *B25B 27/00* (2013.01)

(58) Field of Classification Search

CPC ..... B25B 27/00; B25B 27/14; B25B 27/16
USPC ..... 254/104, 131, 42, 133 R, 93 R; 81/485
See application file for complete search history.

(56) References Cited

U.S. PATENT DOCUMENTS

| | | | | |
|---|---|---|---|---|
| 4,022,010 | A * | 5/1977 | Gladenbeck et al. | 57/231 |
| 4,114,977 | A * | 9/1978 | Polidori | 439/791 |
| 6,164,608 | A * | 12/2000 | Schiel, Jr. | 248/188.2 |
| 2007/0220945 | A1 * | 9/2007 | Rose | 72/457 |

* cited by examiner

*Primary Examiner* — Lee D Wilson
*Assistant Examiner* — Seahee Yoon
(74) *Attorney, Agent, or Firm* — Antony P. Ng; Russell Ng PLLC

(57) ABSTRACT

A pipe flange spreading tool is disclosed. The pipe flange spreading tool includes a pair of wedges and a retainer strap. Each of the wedges has a tapered end, and the tapered end is configured to be forced between two pipe flanges of a pipeline to separate the pipe flanges of the pipeline. The retainer strap connects the pair of wedges. The retainer strap is configured to be looped around the pipeline to retain the pair of wedges with respect to the pipeline during operation.

10 Claims, 1 Drawing Sheet

PIPE FLANGE SPREADING TOOL

BACKGROUND OF THE INVENTION

1. Technical Field

The present invention relates to pipelines in general, and in particular to a pipe flange spreading tool for pipelines.

2. Description of Related Art

Pipelines are frequently utilized to transport oil or gas from one location to another. A pipeline is typically formed by multiple pipes, each pipe having flanges on opposite ends to facilitate coupling to other pipes. Multiple fasteners (e.g., threaded bolts) may be employed to secure one pipe flange to another pipe flange.

On many occasions, it is necessary to spread the flanges of corresponding pipes to facilitate pipe maintenance and/or replacement. Conventional flange spreading tools tend to be bulky, expensive and relatively difficult to operate. Consequently, it would be desirable to provide an improved flange spreading tool.

SUMMARY OF THE INVENTION

In accordance with a preferred embodiment of the present invention, a pipe flange spreading tool includes a pair of wedges and a retainer strap. Each of the wedges has a tapered end, and the tapered end is configured to be forced between two pipe flanges of a pipeline to separate the pipe flanges of the pipeline. The retainer strap connects the pair of wedges. The retainer strap is configured to be looped around the pipeline to retain the pair of wedges with respect to the pipeline during operation.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
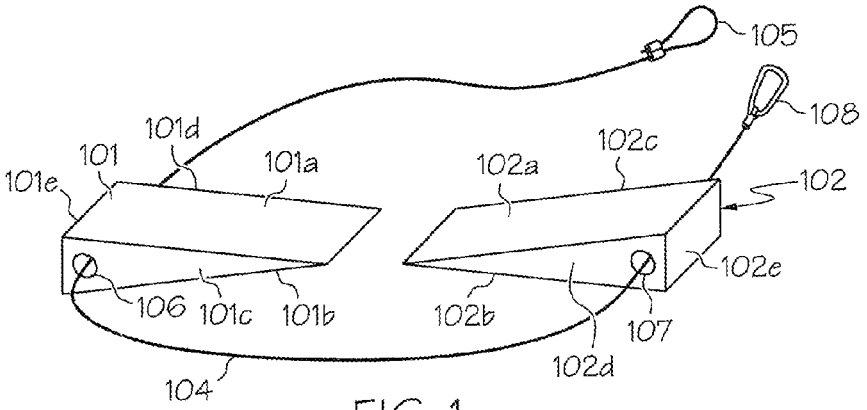
FIG. 1 is an isomeric view of a pipe flange spreading tool, in accordance with a preferred embodiment of the present invention.

Referring now to the drawings and in particular to FIG. 1, there is depicted an isomeric view of a pipe flange spreading tool, in accordance with a preferred embodiment of the present invention. As shown, a flange spreading tool 100 includes a first wedge 101 and a second wedge 102 secured by a retainer strap 104. One end of retainer strap 104 includes a loop 105, and the other end of retainer strap 105 includes a carabiner 108. First wedge 101 is substantially identical to second wedge 102. First wedge 101 has a first front face 101*a*, a second front face 101*b*, a first side face 101*c*, a second side face 101*d* and a top face 101*e*. Similarly, second wedge 102 has a first front face 102*a*, a second front face 102*b*, a first side face 102*c*, a second side face 102*d* and a top face 102*e*. Each of first and second wedges 101, 102 has a tapered end. First wedge 101 includes a small aperture 106 that is sized to slidingly receive retainer strap 104. Similarly, second wedge 102 include a small aperture 107 that is sized to slidingly receive retainer strap 104.

First and second wedges 101, 102 can be made of a wide variety of materials. Preferably, first and second wedges 101, 102 are casted of aluminum-bronze-copper alloy. Since aluminum-bronze-copper alloy does not produce sparks when being struck, it is suitable to be used for applications in hazardous conditions where combustible or flammable liquids, gases and dust residues are present in pipelines. Such hazardous conditions are present in MRO, chemical, petrochemcal, military, utility, waste management and hazmat.

Otherwise, first and second wedges 101, 102 can be forged of carbon steel for applications where denser metal structure is required to resist deforming forces that occur when first and second wedges 101, 102 must be hit hard in order to place them between pipe flanges of pipelines for carrying non-hazardous materials. Forged carbon steel is highly resistant to deforming and is longer lasting.

Retainer strap 104 can be made of a wide variety of resilient materials. For example, retainer strap 104 may be made of a synthetic rubber material or polyurethane with a tensile strength of at least about 200 pounds per square inch (psi).

Figure 2:
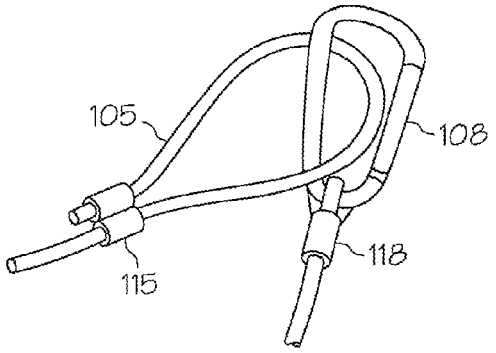
FIG. 2 is a diagram of the interlocking action between a carabiner and a loop of a retainer strap of the pipe flange spreading tool from FIG. 1, in accordance with a preferred embodiment of the present invention.

With reference now to FIG. 2, there is illustrated a diagram of the interlocking action between loop 105 and carabiner 108 of retainer strap 104 from FIG. 1, in accordance with a preferred embodiment of the present invention. As shown, carabiner 108 is connected to one end of retainer strap 104 via an aluminum fitting 118. Loop 105 is formed by using an aluminum fitting 115 to crimp another end of retainer strap 104. Preferably, one side of aluminum fitting 115 is secured to retainer strap 104 to prevent retainer strap 104 from sliding within aluminum fitting 115, and the other side of aluminum fitting 115 is not secured to retainer strap 104 such that the size of loop 105 can be adjusted by sliding retainer strap 104 within aluminum fitting 115.

Figure 3:
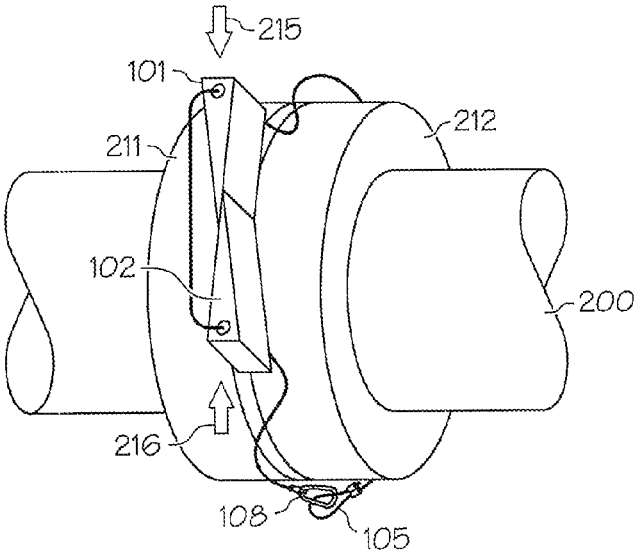
FIG. 3 is a diagram illustrating the pipe flange spreading tool from FIG. 1 being used to separate two pipe flanges.

Referring now to FIG. 3, there is depicted pipe flange spreading tool 100 being used to separate two pipe flanges. As shown, first and second wedges 101, 102 are deployed between pipe flanges 211, 212 of a pipeline 200 for spreading pipe flanges 211, 212. It should be appreciated that prior to deployment of first and second wedges 101, 102 between pipe flanges 211, 212, the fasteners (such as bolts and nuts) that mechanically coupled pipe flanges 211, 212 have already been removed.

One of the ends of retainer strap 104 includes a loop 108 such that retainer strap 104 as well as first and second wedges 101, 102 can be secured around pipeline 200 by passing the non-loop end of retainer strap 104 through loop 108. When inserting first and second wedges 101, 102 between pipe flanges 211, 212, retainer strap 104 can be pulled to tighten first wedge 101 against second wedge 102. Alternatively, the ends of retainer strap 104 can be secured around pipeline 200 using a knot such as a square knot.

Forces can be applied to first and second wedges 101, 102 in the directions shown by arrows 215, 216 to drive first and second wedges 101, 102 between pipe flanges 211, 212 to spread them apart. The forces can be applied alternatively on first and second wedges 101, 102 via a hammer (not shown). After pipe flanges 211, 212 have been spread apart, a stop or "blind" can be inserted between pipe flanges 211, 212.

As has been described, the present invention provides a pipe flange spreading tool that is advantageously configured to separate pipe flanges while reducing the risk of injury to maintenance personnel due to flying wedges.

While the invention has been particularly shown and described with reference to a preferred embodiment, it will be understood by those skilled in the art that various changes in form and detail may be made therein without departing from the spirit and scope of the invention.

What is claimed is:

1. A tool for spreading pipe flanges, said tool comprising:

a pair of wedges each wedge having first and second front faces, first and second side faces, a top face, said first and second front faces converging together to form a tapered end extending between said first and second side faces opposite said top face, each wedge having a hole, wherein said tapered end is configured to be forced between two pipe flanges of a pipeline to separate said pipe flanges of said pipeline; and a retainer strap passing through said holes for connecting said pair of wedges, wherein said retainer strap is allowed to freely move along said holes, and is configured to be looped around said pipeline to retain said pair of wedges with respect to said pipeline during operation.

2. The tool of claim 1, wherein said retainer strap is made of synthetic rubber.

3. The tool of claim 2, wherein said retainer strap has a tensile strength of at least approximately 200 pounds per square inch.

4. The tool of claim 1, wherein said retainer strap is made of polyurethane.

5. The tool of claim 4, wherein said retainer strap has a tensile strength of at least approximately 200 pounds per square inch.

6. The tool of claim 1, wherein said pair of wedges are made of aluminum-bronze-copper alloy.

7. The tool of claim 1, wherein said pair of wedges are made of carbon steel.

8. The tool of claim 1, wherein said first and second front faces are in substantially rectangular shapes.

9. The tool of claim 1, wherein said first and second side faces are in substantially triangular shapes.

10. The tool of claim 1, wherein said top face is in a substantially rectangular shape.

* * * * *